US005683275A

United States Patent [19]

Nanami

[11] Patent Number: 5,683,275

[45] Date of Patent: Nov. 4, 1997

[54] AUTOMATIC TRIM CONTROL FOR JET BOAT

[75] Inventor: Masayoshi Nanami, Hamamatsu, Japan

[73] Assignee: Sanshin Kogyo Kabushiki Kaisha, Hamamatsu, Japan

[21] Appl. No.: 567,557

[22] Filed: Dec. 5, 1995

[30] Foreign Application Priority Data

Dec. 5, 1994 [JP] Japan ..... 6-300680

[51] Int. Cl.[6] ..... B63H 11/00

[52] U.S. Cl. ..... 440/38; 440/47

[58] Field of Search ..... 440/1, 2, 38, 39, 440/40, 41, 42, 61, 57, 47; 114/270

[56] References Cited

U.S. PATENT DOCUMENTS 3,788,265 1/1974 Moore ..... 440/42
3,834,345 9/1974 Hager et al. ..... 440/57
3,906,885 9/1975 Woodfill ..... 440/42
4,051,801 10/1977 Woodfill et al. ..... 440/42
5,507,672 4/1996 Imaeda ..... 440/42
5,540,174 7/1996 Kishi et al. ..... 440/42

*Primary Examiner*—Stephen Avila
*Attorney, Agent, or Firm*—Knobbe, Martens, Olson & Bear LLP

[57] ABSTRACT

A trim adjusting system for a small jet propelled personal watercraft. The trim is adjusted automatically in response to sensed water conditions which will indicate, among other things, the condition of the water flowing through the water inlet opening of the jet propulsion unit. The measured conditions may include water condition, watercraft speed and watercraft trim angle. The arrangement also permits manual operation and the permissible range of trim adjustment is less in manual operation than in automatic operation.

9 Claims, 6 Drawing Sheets

AUTOMATIC TRIM CONTROL FOR JET BOAT

BACKGROUND OF THE INVENTION

This invention relates to a small jet propelled watercraft and more particularly to an automatic trim control for such watercraft.

So-called "personal watercraft" are becoming quite popular. This type of watercraft is comprised of a hull in which an engine and propulsion unit are positioned and which are designed to be operated primarily by single rider with no more than two or three passengers. Frequently the propulsion unit for this type of watercraft is comprised of a jet propulsion unit which is mounted in the underside of the hull and which has a downwardly facing water inlet opening through which water is drawn. This water is drawn by an impeller that is driven by the engine and which discharges the water rearwardly through a discharge nozzle for propelling the watercraft. The discharge nozzles are oftentimes supported for steering movement about a generally vertically extending axis so as to permit steering of the watercraft.

In connection with this type of watercraft, as with more conventional propeller powered watercraft, the trim of the watercraft is particularly important in determining its performance and running characteristics. It has been proposed, therefore, to adjust the trim condition of such watercraft in a variety of manners. One manner of accomplishing trim adjustment is by pivoting the discharge nozzle about a horizontally disposed axis so as to change the angle of water discharge relative to the longitudinal center line of the watercraft. In this way, the trim can be adjusted.

Although manual trim control is possible, this relies primarily on the judgment of the operator and, at times, the manual control may not provide the optimum trim position for the discharge nozzle.

It is, therefore, a principal object of this invention to provide an improved automatic trim adjustment for a watercraft of this type.

The optimum trim condition for the watercraft when propelled by a jet propulsion unit is determined by factors different than those associated with conventional propeller powered watercraft. That is, the optimum trim condition in a propeller powered watercraft is frequently determined by the optimum trim angle of the propeller shaft relative to the hull and is somewhat independent of various other factors. With jet propelled watercraft, on the other hand, the trim condition also will effect the condition of the water at the water inlet of the jet propulsion unit.

As is well known, jet propulsion units are subject to cavitation and, therefore, in addition to the basic handling conditions of the hull the trim angle can at times either aid in preventing cavitation or may in fact cause cavitation. That is, if the nose or bow of the watercraft is riding too high, then cavitation may result. The same result can occur to a lesser extent if the trim is too low.

It is, therefore, a still further object of this invention to provide an improved automatic trim control for a jet propelled watercraft wherein the optimum angle is set dependent upon the water inlet conditions among other factors.

For the same reasons as already noted, the condition of the water itself may determine what is the optimum trim condition. However, previous trim controls have controlled the trim directed primarily on the basis of the watercraft condition and not that of the water. Thus, with a jet propelled watercraft the optimum trim position based upon the hull alone might not be appropriate and might cause cavitation and other problems to be encountered.

It is, therefore, a still further object of this invention to provide an improved automatic trim control for a jet propelled watercraft wherein the water condition is sensed and the trim is adjusted in response to the sensed water condition either alone or in addition to the other factors.

In conjunction with automatic and manual trim control, frequently the manufacturers may limit the degree of permissible trim control for safety and other reasons. This is because the manual control of the trim might inadvertently be set by the operator to be greater than that which is safe. That is, the manufacturer must anticipate the skill of the operator and frequently therefore the maximum trim position that is permitted is less than may be desirable because of the necessity to add such a safety factor.

It is, therefore, a still further object of this invention to provide an improved trim control for a watercraft which can operate either manually or automatically and the amount of trim permitted is greater in the automatic mode than in the manual mode.

SUMMARY OF THE INVENTION

A first feature of this invention is adapted to be embodied in a small jet propelled watercraft that is comprised of a hull which defines a rider's area. The hull also defines an engine compartment in which an engine is contained which drives a jet propulsion unit for propelling the watercraft. The jet propulsion unit is comprised of a downwardly facing water inlet opening formed in the underside of the hull through which water is drawn by an impeller which is driven by the engine. This water is discharged then through a discharge nozzle for a propulsion of the watercraft. The discharge nozzle is supported for pivotal movement about a horizontally disposed trim axis for setting the trim angle of the discharge nozzle. In accordance with this feature of the invention, means are provided for sensing a condition of the watercraft and for automatically adjusting the trim angle of the discharge nozzle in response to the sensed condition.

Another feature of the invention is adapted to be embodied in a small watercraft having a hull, an engine and a jet propulsion unit having a discharge nozzle as set forth in the preceding paragraph. In accordance with this feature of the invention, means are provided for setting either manual or automatic control of the trim of the discharge nozzle. The degree of pivotal movement permissible under manual control is set to be substantially smaller than that under automatic control.

DETAILED DESCRIPTION OF THE PREFERRED EMBODIMENTS

Figure 1:
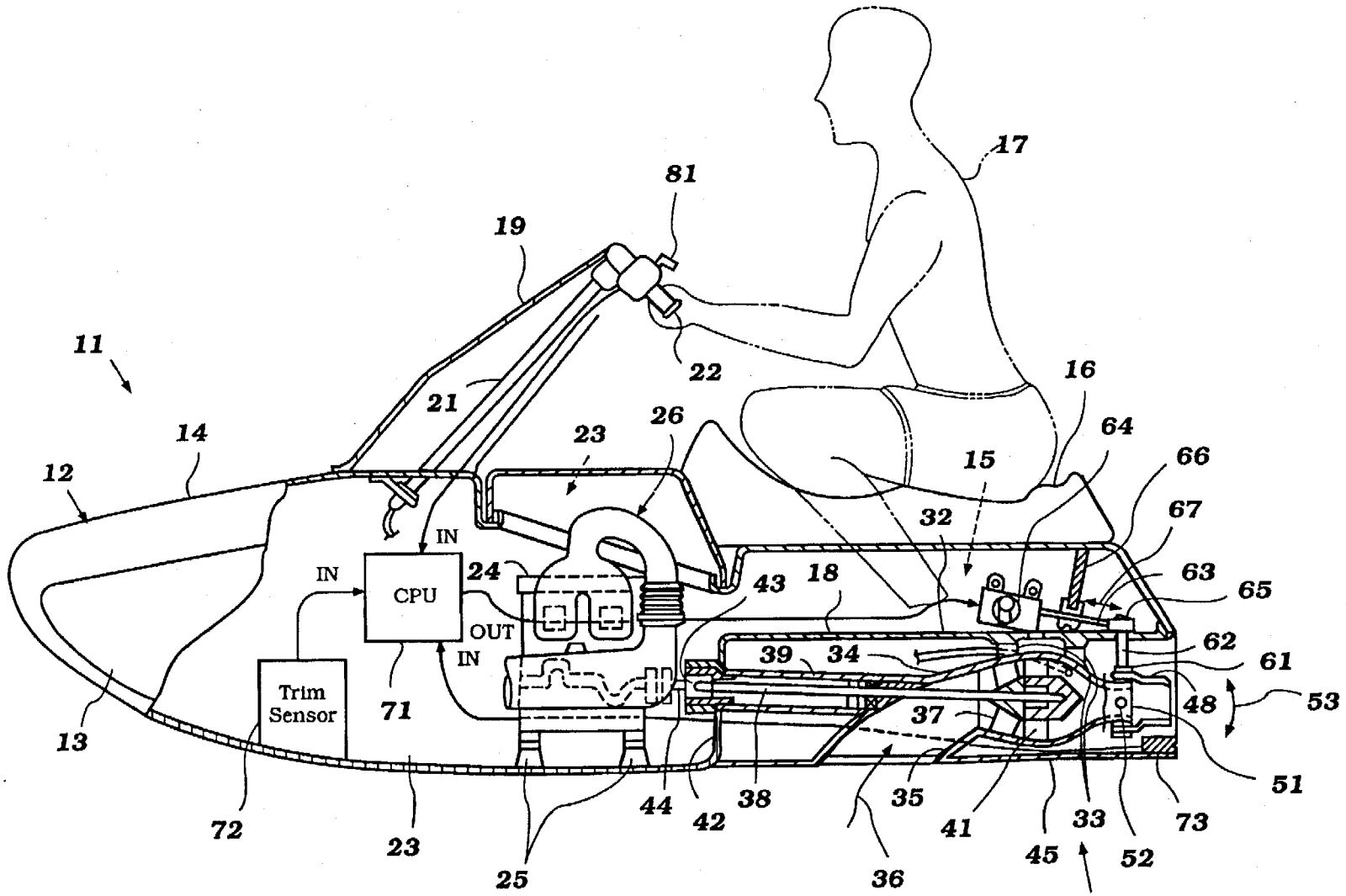
FIG. 1 is a side elevational view of a watercraft constructed in accordance with an embodiment of the invention with portions broken away and showing various internal components in section.

Referring in detail to the drawings and initially to FIG. 1, a small personal watercraft constructed in accordance with an embodiment of this invention is identified generally by the reference numeral 11. Although the invention is described in conjunction with a personal watercraft, it should be readily apparent to those skilled in the art that the invention can be employed in a wide variety of types of watercraft. The invention has particular utility in conjunction with jet propulsion units for watercraft and personal watercraft are frequently powered by jet propulsion units. Thus, the watercraft 11 is a typical environment in which the invention can be practiced. It is to be understood, however, that the invention may be applied to a wide variety of types of watercraft in addition to that illustrated.

The watercraft 11 is comprised of a hull indicated generally by the reference numeral 12 and which is comprised of a lower hull portion 13 and an upper deck portion 14. The portions 13 and 14 are formed from any suitable material, such as a molded fiberglass resin or the like. Hull and deck portions 13 and 14 are connected to each other in any suitable manner.

A rider's area 15 is formed to the rear of the watercraft 11 and accommodates a seat 16 that is adapted to receive a rider shown in phantom and identified by the reference numeral 17. The rider 17 sits on the seat 16 in a straddle fashion with his feet on foot areas 18 formed on opposite sides of the seat 16 and in the rider's area 15.

A mast assembly 19 is provided forwardly of the seat 16 and journals a steering shaft 21 in a known manner. A handle bar assembly 22 is carried at the upper end of the steering shaft 21 for steering of the watercraft 11 by the operator 17 in a manner to be described. In addition, other watercraft controls such as throttle and ignition controls may be carried by the handle bar assembly 22 or by the mast 19.

The hull 12 defines an engine compartment 23 at whose lower surface an engine 24 is mounted by means of mounting plates 25 forward of the rider's area 15 and accessible through a cover 26. The cover 26 is affixed in any known manner to the upper deck 14. Fuel is supplied to the engine 24 by fuel tank (not shown) disposed in the forward portion of the engine compartment 23.

The engine 24 has an exhaust system 27 which exhausts the combustion products and the engine cooling water from the engine water jackets to the atmosphere in a suitable manner.

The lower rear central portion of the hull 12 and specifically the area of the hull portion 13 beneath the seat 16 is formed with a tunnel-like recess indicated generally by the reference numeral 32. A jet propulsion unit 31 is supported in the tunnel 32 by means including mounting brackets 33. The jet propulsion unit 31 includes an outer housing assembly 34 that defines a downwardly facing water inlet portion 35 through which water is drawn in the direction shown by the arrow 36.

This water is drawn by an impeller 37 that is affixed on an impeller shaft 38 which is journaled in the outer housing 34 and which passes through a forwardly extending tubular portion 39 thereof. At its rearward end the impeller shaft 38 is journalled within a nacel 40 that is mounted within the jet propulsion unit 31 by means of straightening vanes 41

The tubular portion 39 of the outer housing assembly 34 terminates at a bulkhead 42 which is formed at the forward end of the tunnel 32. The impeller shaft 38 extends through the bulkhead 42 and connects through a flexible coupling mechanism 43 to the engine output shaft 44.

The underside of the tunnel 32 is closed by a bottom plate 45 which is affixed to the hull portion 13 in any known manner. The bottom plate 45 either has an opening which surrounds the water inlet opening 35 of the jet propulsion unit outer housing 34 or terminates short of it so that water can be freely drawn through the path 36.

The outer housing 34 of the jet propulsion unit 31 to the rear of the impeller 37 is provided with a reduced diameter discharge nozzle 46 which faces generally rearwardly. The vanes 41 that are disposed forward of the discharge nozzle 46 straighten the water that is delivered to the discharge nozzle 46.

A steering nozzle, indicated generally by the reference numeral 48, is supported on this discharge nozzle 46 in a manner which will be described so as to control the direction of flow of the water so as to effect steering of the watercraft 11 in a manner that is generally known, but also so as to provide a trim adjustment therefor. The steering nozzle 48 has a forward portion that extends forwardly beyond the discharge nozzle 46 of the outer housing 34 of the jet propulsion unit 31. This surrounds a gimbal ring 51. A pair of vertically extending pivot pins (not shown) connect the steering nozzle 48 and specifically this forward portion to the gimbal ring 51 for steering movement about a generally vertically extending steering axis defined by these pivot pins. The handlebar 22 is connected suitably to the steering nozzle for effecting this pivotal movement. A bowden wire actuator (not shown) may be included in this connection.

The gimbal ring 51 is in turn pivotally connected to the outer housing 34 of the jet propulsion unit 31 around its discharge nozzle 46. A pair of horizontally extending pivot bolts 52 are threaded into the outer housing 34 adjacent to the discharge nozzle 46 and provide this pivotal connection. Pivotal movement of the gimbal ring 51 about the horizontal axis defined by the pivot bolts 52 will be accompanied by pivotal movement of the steering nozzle 48 in this same direction. By effecting this pivotal movement, the direction of water exiting the steering nozzle 48 may be changed in a vertical orientation as shown by line 53 so as to change the effective trim of the watercraft 11.

A trim ring 61 is affixed to the upper portion of the steering nozzle 48 above the upper steering pivot pin. A trim control arm 62 is connected at its lower end to the trim ring 61 while at its upper end the control arm 62 connects to a shaft 63 of an electric motor 64 by means of a ball joint 65. The electric motor 64 is located below the rearmost portion of the seat 16 forward of a bulkhead 66 through which the shaft 63 extends.

Operation of the motor 64 causes the shaft 63 to move either forward or rearward as indicated by the arrows 67. This, in turn, causes the upper end of the trim control arm 62 to move in the same direction of the shaft 63 which, in turn, causes the steering nozzle 48 to pivot about an axis defined by the pivot bolts 52. Thus, it is seen that the above mechanism effectively enables the trim of the watercraft 11 to be varied.

The attitude of the watercraft 11 relative to the water in which it is operating tends to vary under varying operating conditions. For example, the attitude will change as the speed of the watercraft 11 changes or if the rider 17 moves forwardly or rearwardly along the seat 16. This attitude change greatly influences the performance of the jet propulsion unit 45 and also effects the handling of the watercraft 11. An embodiment of this invention utilizes an feedback control system that disposes the watercraft 11 at an optimum attitude relative to the body of water in which it is operating by adjusting the trim of the steering nozzle 48 of the jet propulsion unit 34.

A CPU is indicated generally by the reference numeral 71 and is disposed in the engine compartment 23 forward of the engine 24. The CPU 71 receives a signal from a trim sensor 72 positioned in the engine compartment 23 forward and underneath the CPU 71 that is indicative of the attitude of the watercraft 11 and receives a further signal from a speed sensor 73 positioned at the rear of the bottom plate 45 beneath the steering nozzle 48 that is indicative of the speed at which the watercraft 11 is moving through the body of water in which it is operating.

Figure 2:
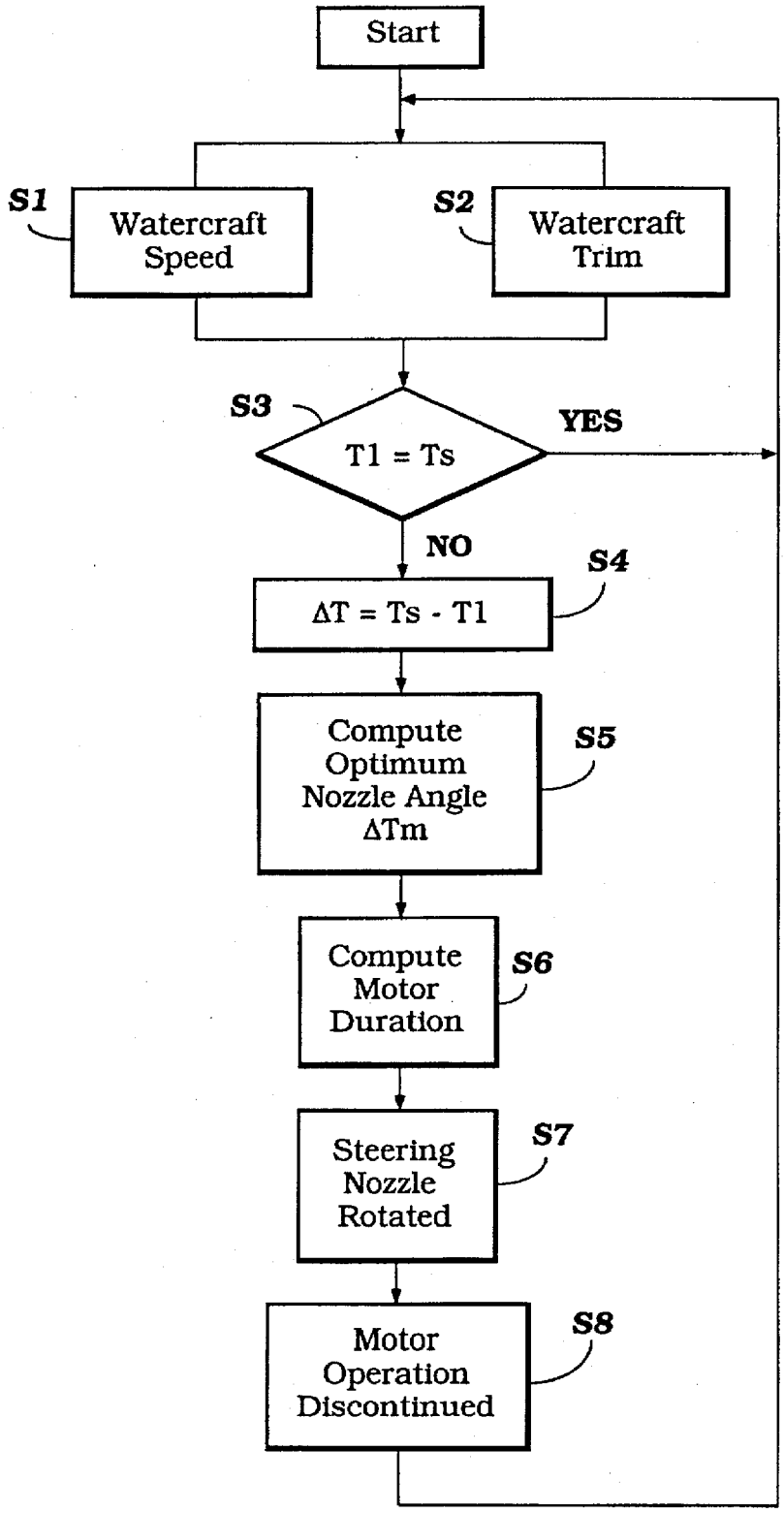
FIG. 2 is a flow chart that illustrates a control routine for an embodiment of the invention.

The CPU 71 sets the attitude of the watercraft 11 by adjusting the trim to an angle that is determined by a control sequence that is shown in FIG. 2. The sequence begins and goes to step S1 and step S2 which occur simultaneously. In step S1, the speed sensor 73 outputs a signal indicative of the watercraft speed to the CPU 71 while in step S2 the trim sensor 72 outputs a signal to the CPU 71 as indicative of the current trim of the watercraft 11.

The sequence then proceeds to step S3 where the current trim T1 is compared to a stored trim value $T_s$ which is the optimum trim for watercraft 11 for the speed indicated by the speed sensor 73. If $T_1$ equals $T_s$ then the watercraft 11 is trimmed optimally and no adjustments are necessary. If this is the case the sequence returns to its starting point and repeats.

If $T_1$ does not equal $T_s$ then the sequence moves to step S4 where the difference $\Delta T$ between the trim angles is determined. In step S5, the change in nozzle trim angle $\Delta T_m$ at which $\Delta T$ will be returned to zero is determined by the CPU 71. This is the angular amount that the steering nozzle 48 must be rotated in order to dispose the watercraft in the body of water in which it is operating at the optimum attitude.

The sequence then proceeds to step S6 where it is determined how long the motor 64 must operate to rotate the steering nozzle 48 through the angle $\Delta T_m$ and then on to step S7 where the motor 64 rotates the steering nozzle 48 the desired amount by running the motor 64 for the computed time. The sequence then terminates at step S8 where the motor 64 discontinues operating on the steering nozzle 48 which is now disposed at the optimum trim angle as determined by the CPU 71.

Figure 3:
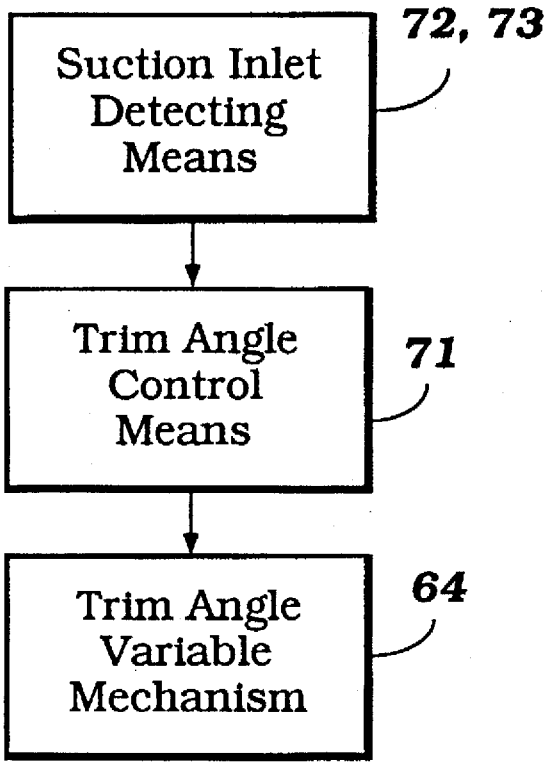
FIG. 3 is a block diagram of the components associated with the embodiment illustrated in FIG. 2.

The aforedescribed trim adjustment also factors in to its pre-mapped data the optimum trim angle to insure that the jet propulsion unit water inlet opening 35 is disposed at an angle to the water level so as to avoid cavitation. This is illustrated schematically in FIG. 3. The suction inlet detection means, namely the trim and speed sensors 72 and 73 respectively, communicate the watercraft attitude to a trim angle control means, namely the CPU 71. The CPU 71 then determines the trim changes necessary to dispose the watercraft 11 at the optimum trim setting taking into account the desire to avoid cavitation and signals the trim angle variable mechanism, namely the motor 64, which adjusts the steering nozzle 48 to the desired trim setting.

For the above control sequence, the optimum trim for the watercraft 11 is determined based on the measured trim and speed of the watercraft 11. This optimum trim is determined by the CPU 71 which uses a map for determining conditions at the water inlet 35 that takes into account such things as cavitation and water flow through the tunnel 32 for a given trim and speed.

Figure 4:
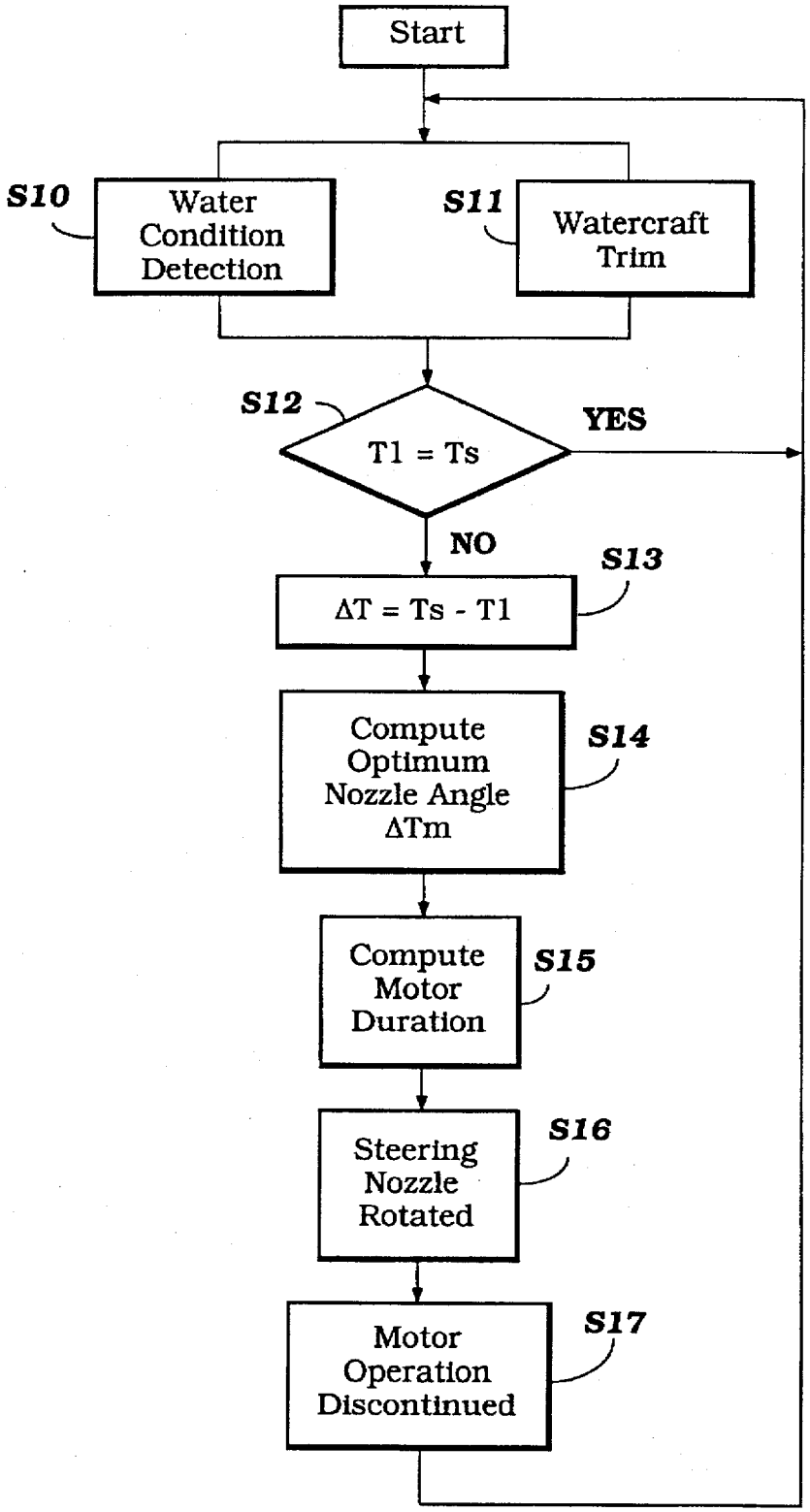
FIG. 4 is a flow chart, in part, similar to FIG. 2 and illustrates another embodiment of the invention.

This control sequence does not, however, to take into account the condition of the body of water in which the watercraft 11 is operating. A further control sequence in which the condition of the body of water in which the watercraft 11 is operating is shown in FIG. 4 and described below. This sequence may be used in combination with the sequence already described or alone.

The sequence begins and goes to steps S10 and S11. In step S10 the trim sensor 72 is used to determine the condition of the body of water in which the watercraft 11 is operating. This is done by taking two measurements of the trim over a given period of time. In this manner, the roughness or smoothness of the body of water is accurately represented by the variation of the watercraft's trim recorded for the given period of time. A signal indicative of this condition is outputted to the CPU 71. In step S11 the trim sensor 72 outputs a signal to the CPU 71 that is indicative of the current trim of the watercraft 11.

The sequence then proceeds to step S12 where the current trim $T_1$ is compared to a stored value $T_s$ which is the optimum trim for the watercraft 11 for the water condition as determined by step S10. If $T_1$ is equal to $T_s$ then the watercraft 11 is trimmed optimally and no adjustments are necessary. If this is the case, the sequence returns to its starting point and repeats.

If, however, $T_1$ does not equal $T_s$ then the sequence moves to step S13 where the difference between the trim angles $\Delta T$ is determined. In step S14 the nozzle trim angle $\Delta T_m$ at which $\Delta T$ will become 0 is determined by the CPU 71. The sequence then proceeds to step S15 where it is determined how long the motor 64 must operate to rotate the steering nozzle 48 through the angle $\Delta T_m$ and then to step S16 where the motor 64 rotates steering nozzle 48 the determined time. The sequence then terminates at step S17 where the motor 64 discontinues operating on the steering nozzle 48 which is now disposed at the optimum trim angle as determined by the CPU 71.

Figure 5:
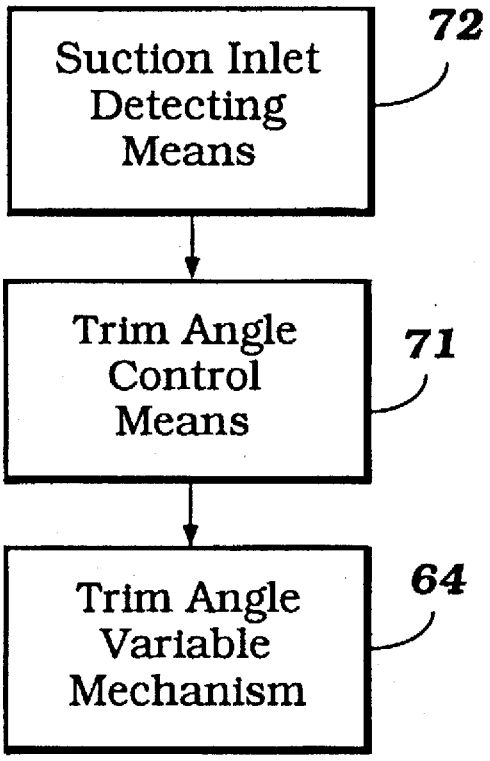
FIG. 5 is a block diagram of the components associated with the embodiment of FIG. 4.

Again the optimum trim angle also is determined to de one at which cavitation in the jet propulsion unit 31 will be avoided. This is shown in the block diagram of FIG. 5. It is seen that the suction inlet conditions, which are a function in this embodiment of the water conditions and the watercraft trim, are communicated to the trim angle control means, namely the CPU 71, which determines any trim changes necessary for optimum watercraft attitude and signals the trim angle variable mechanism, namely the motor 64, which adjusts the steering nozzle 48 to the desired trim setting.

It should be readily apparent that the above-described control sequences constitute means by which a watercraft 11 may be operated at an automatically set optimal trim attitude for any given speed, with any number of allowable passengers aboard, and in varying water conditions.

Figure 6:
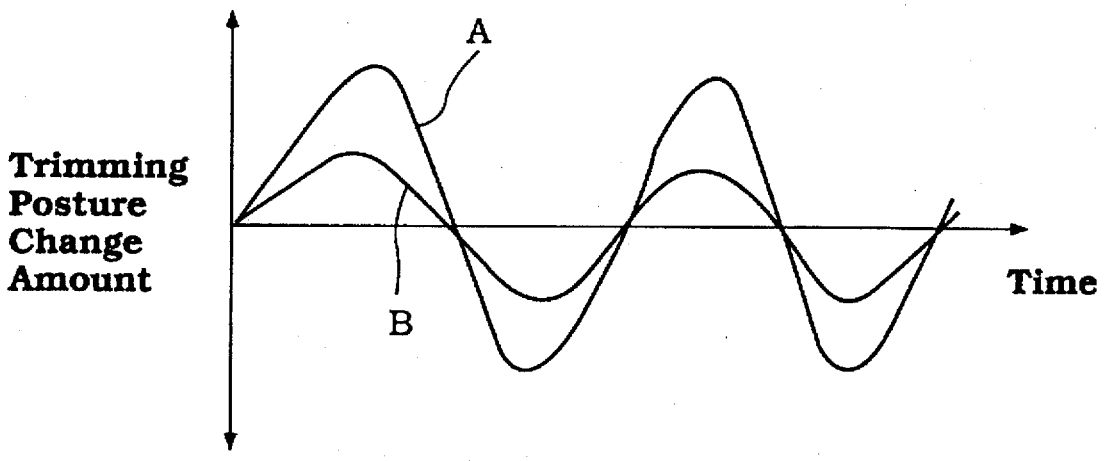
FIG. 6 is a graph of trim posture with respect to time to illustrate the advantages associated with an embodiment of the invention.

It is the practice of this type of watercraft to allow the rider 17 to manually control the trim of the steering nozzle 48. This is accomplished by a manual trim adjust control 81 which when in operation overrides the desired trim setting determined by the CPU 71. A problem exists with the manual trim control, however, in that the rider 17 typically tends to add and remove trim in excess of the optimum amount. This is shown in FIG. 6 where curve A represents trim corrections made by a typical rider and curve B represents the optimal trim settings made by the automatic control of the CPU 71. It will be seen that the automatic control actually maintains the desired trim with reduced amounts of instantaneous trim adjustment.

Because of the tendency for the operator controlled systems to be over adjusted, these systems frequently limit the total amount of permitted trim adjustment. This is not necessary with the systems utilizing the invention, at least in automatic mode.

Figure 7:
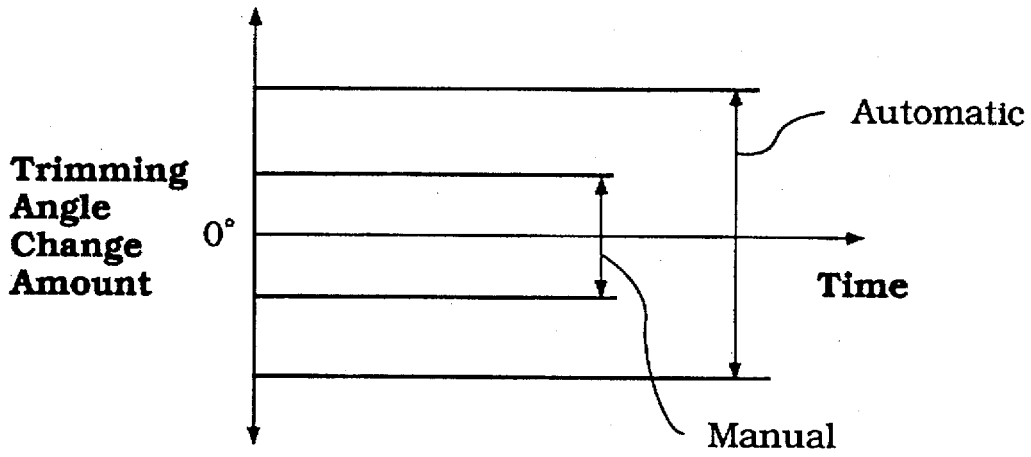
FIG. 7 is a graph that illustrate the degree of trim control permissible under either manual or automatic control in accordance with an embodiment of the invention.

Another embodiment of this invention controls the overcompensating tendencies of the rider 17 by limiting the magnitude of the manual trim adjustments as is shown in FIG. 7. It is clearly seen that excess manual trim inputs are no longer possible since the range of manual trim angle variation has been greatly reduced and lies well within the automatic trim angle variation range. However when operating in automatic mode, wider adjustments are permitted to accommodate more rapidly changing conditions.

From the foregoing description it should be readily apparent that the described apparatus provides a very effective means for disposing a personal watercraft at an optimum attitude within the body of water in which it is operating. Of course, the foregoing description is that of a preferred embodiment of the invention and various changes and modifications may be made without departing from the spirit and scope of the invention as defined by the appended claims.

What is claimed is:

1. A small jet propelled watercraft comprised of a hull defining a rider's area, an engine compartment defined by said hull and containing an internal combustion engine, a jet propulsion unit carried by said hull and driven by said engine for propelling said watercraft, said jet propulsion unit being comprised of a downwardly facing water inlet opening formed in an undersurface of the hull through which water is drawn, an impeller driven by said engine for drawing water through said water inlet portion and a discharge nozzle portion through which the pumped water is discharged for propelling said watercraft, said discharge nozzle portion being supported for pivotal movement about a horizontally extending trim axis for adjusting the angle of discharge of said water relative to said hull, means for sensing a condition of said watercraft, an automatically operated power device for setting the trim angle of said discharge nozzle portion in response to said sensed condition, a manually operable device for providing manual adjustment of the trim angle of the discharged nozzle, and means for limiting the range of trim adjustment so that the range of trim adjustment under manual control is set to be smaller than the permissible range of trim adjustment under automatic control.

2. A small jet propelled watercraft comprised of a hull defining a rider's area, an engine compartment defined by said hull and containing an internal combustion engine, a jet propulsion unit carried by said hull and driven by said engine for propelling said watercraft, said jet propulsion unit being comprised of a downwardly facing water inlet opening formed in an undersurface of the hull through which water is drawn, an impeller driven by said engine for drawing water through said water inlet portion and a discharge nozzle portion through which the pumped water is discharged for propelling said watercraft, said discharge nozzle portion being supported for pivotal movement about a horizontally extending trim axis for adjusting the angle of discharge of said water relative to said hull, means for sensing a condition of said watercraft, and an automatically operated power device for setting the trim angle of said discharge nozzle portion in response to said sensed condition, said sensed condition comprising the condition of the body of water in which the watercraft is operating.

3. A small jet propelled watercraft comprised of a hull defining a rider's area, an engine compartment defined by said hull and containing an internal combustion engine, a jet propulsion unit carried by said hull and driven by said engine for propelling said watercraft, said jet propulsion unit being comprised of a downwardly facing water inlet opening formed in an undersurface of the hull through which water is drawn, an impeller driven by said engine for drawing water through said water inlet portion and a discharge nozzle portion through which the pumped water is discharged for propelling said watercraft, said discharge nozzle portion being supported for pivotal movement about a horizontally extending trim axis for adjusting the angle of discharge of said water relative to said hull, means for sensing a condition of said watercraft, and an automatically operated power device for setting the trim angle of said discharge nozzle portion in response to said sensed condition, said sensed condition comprising the condition of the water at the water inlet of the jet propulsion unit.

4. A small jet propelled watercraft as set forth in claim 3, wherein the condition of the water at the water inlet is determined by measuring the speed of the watercraft.

5. A small jet propelled watercraft as set forth in claim 3, wherein the condition of the water at the inlet is determined by measuring the trim of the watercraft.

6. A small jet propelled watercraft as set forth in claim 5, wherein the condition of the water at the water inlet is also determined by measuring the speed.

7. A small jet propelled watercraft as set forth in claim 3, wherein the condition of the water at the water inlet is measured by measuring the condition of the water of the body in which the watercraft is operating.

8. A small jet propelled watercraft comprised of a hull defining a rider's area, an engine compartment defined by said hull and containing an internal combustion engine, a jet propulsion unit driven by said engine for propelling said watercraft and carried by said hull, said jet propulsion unit comprising a water inlet opening through which water is drawn by an impeller driven by said engine and which water is discharged through a discharge nozzle, said discharge nozzle being pivotal about a horizontally disposed trim axis for adjustment of the trim of said watercraft, power operated means for adjusting said trim of said discharge nozzle, and control means for controlling said power operated means for permitting either manual operation or automatic operation, the trim adjusted range of said power means being limited to a smaller angular range when operating in the manual mode than when operating in the automatic mode.

9. A small jet propelled watercraft comprised of a hull defining a rider's area, an engine compartment defined by said hull and containing an internal combustion engine, a jet propulsion unit carried by said hull and driven by said engine for propelling said watercraft, said jet propulsion unit being comprised of a downwardly facing water inlet opening formed in an undersurface of said hull through which water is drawn, an impeller driven by said engine for drawing water through said water inlet portion and a discharge nozzle portion through which the pumped water is discharged for propelling said watercraft, said discharge nozzle portion being supported for pivotal movement about a horizontally extending trim access for adjusting the angle of discharge of said water relative to said hull, means for sensing the speed of said hull, means for measuring the trim of said hull, and an automatically operated power device for setting the trim angle of said discharge portion in response to a map containing values of trim angles for speed and trim.

* * * * *